US009127684B2

(12) United States Patent
Galeotti

(10) Patent No.: US 9,127,684 B2
(45) Date of Patent: Sep. 8, 2015

(54) METHOD AND DEVICE PERFORMING MODEL BASED ANTI-SURGE DEAD TIME COMPENSATION

(75) Inventor: Daniele Galeotti, Firenze (IT)

(73) Assignee: Nuovo Pignone S.P.A., Florence (IT)

( * ) Notice: Subject to any disclaimer, the term of this patent is extended or adjusted under 35 U.S.C. 154(b) by 960 days.

(21) Appl. No.: 13/252,793

(22) Filed: Oct. 4, 2011

(65) Prior Publication Data

US 2012/0103426 A1 May 3, 2012

(30) Foreign Application Priority Data

Oct. 27, 2010 (IT) ..... CO2010A0060

(51) Int. Cl.
*F04D 27/02* (2006.01)

(52) U.S. Cl.
CPC ..... *F04D 27/0207* (2013.01); *Y10T 137/0324* (2013.01); *Y10T 137/86027* (2013.01)

(58) Field of Classification Search
CPC . F04D 27/02; F04D 27/0207; F04D 27/0215; F04D 27/0223
USPC ..... 137/565.16; 415/26, 27, 28, 29
See application file for complete search history.

(56) References Cited

U.S. PATENT DOCUMENTS 3,240,422 A * 3/1966 Pettersen et al. ..... 415/1
3,809,490 A * 5/1974 Harner ..... 415/28
4,139,328 A * 2/1979 Kuper et al. ..... 415/1
4,184,337 A * 1/1980 Bloch ..... 60/660
RE30,329 E * 7/1980 Rutshtein et al. ..... 415/1
4,274,260 A * 6/1981 Bukajlo ..... 60/663
4,298,310 A 11/1981 Blotenberg
4,384,818 A * 5/1983 Blotenberg ..... 415/1
4,627,788 A * 12/1986 Keyes et al. ..... 415/11
4,656,589 A * 4/1987 Albers et al. ..... 701/100
4,781,524 A 11/1988 Blotenberg
4,936,740 A * 6/1990 Blotenberg ..... 415/27
4,936,741 A * 6/1990 Blotenberg ..... 415/27
4,938,658 A * 7/1990 Blotenberg ..... 415/27
4,946,343 A * 8/1990 Blotenberg ..... 415/27

(Continued)

FOREIGN PATENT DOCUMENTS

CN 101701546 A 5/2010
WO 2007/122499 A1 11/2007

OTHER PUBLICATIONS

IT Search Report issued in priority IT Application CO2010A000060 Date of Search Report Jun. 9, 2011 (10 Pages).

(Continued)

*Primary Examiner* — William McCalister
(74) *Attorney, Agent, or Firm* — GE Global Patent Operation

(57) ABSTRACT

Methods and devices for performing a model based anti-surge dead time compensation in systems including a compressor and an anti-surge loop are provided. A new position of an anti-surge valve on the anti-surge loop is determined by correcting for dead time a value of the anti-surge parameter calculated from field measurements, based on a predicted anti-surge parameter estimated using a deterministic model which has as variables the field measurements and a current position of the anti-surge valve.

8 Claims, 8 Drawing Sheets

(56) References Cited

U.S. PATENT DOCUMENTS

| | | | | |
|---|---|---|---|---|
| 4,948,332 | A * | 8/1990 | Blotenberg | 415/27 |
| 4,949,276 | A * | 8/1990 | Staroselsky et al. | 700/282 |
| 5,195,875 | A * | 3/1993 | Gaston | 417/282 |
| 5,242,263 | A * | 9/1993 | Mondoloni | 415/27 |
| 5,306,116 | A * | 4/1994 | Gunn et al. | 415/27 |
| 5,971,712 | A | 10/1999 | Kann | |
| 6,164,901 | A | 12/2000 | Blotenberg | |
| 6,558,113 | B2 | 5/2003 | Blotenberg | |
| 2004/0193355 | A1 | 9/2004 | Faymon et al. | |
| 2009/0312930 | A1 | 12/2009 | Nakakita et al. | |

OTHER PUBLICATIONS

Hongxia Wu et al: "The impact of time delay on robust control design in power systems", 2002 IEEE Power Engineering Society. Winter Meeting. Conference Proceedings. New York, NY, Jan. 27-31, 2002; [IEEE Power Engineering Society], New York, NY: IEEE, US, vol. 2, Jan. 27, 2002, pp. 1511-1516, XP010578556, DOI: DOI: 10.1109/PESW.2002.985276 ISBN: 978-0-7803-7322-8.

Unofficial English Translation of Chinese Office Action issued in connection with corresponding CN Application No. 201110355034.9 on Mar. 6, 2015.

* cited by examiner

METHOD AND DEVICE PERFORMING MODEL BASED ANTI-SURGE DEAD TIME COMPENSATION

BACKGROUND OF THE INVENTION

1. Field of the Invention

Embodiments of the subject matter disclosed herein generally relate to methods and devices performing a model based anti-surge dead time compensation in systems including a compressor.

2. Description of Related Art

Since oil and natural gas remain a source of energy that cannot be replaced at a significant enough proportion in the world economy, the interest in developing new production fields has continued to increase. Compressors are frequently used in pipelines for transporting the natural gas from a production site to consumers, in oil refineries, refrigeration systems, gas turbines, etc. In a compressor, a pressure of a fluid flow is increased by adding kinetic-energy/velocity to the fluid flow, for example, through rotation of a rotor or an impeller inside the compressor.

A compressor's operation may be affected by the occurrence of a surge phenomenon. The surge phenomenon occurs when the compressor cannot add enough energy to overcome the system resistance, which results in a rapid decrease of the flow and the discharge pressure. The surge occurrence may be accompanied by high vibrations, temperature increases and rapid changes in an axial thrust, which may damage the compressor. Repeated and long lasting surges may result in catastrophic failures. Most systems including compressors are designed to detect a surge trend and to operate to reverse the surge trend. For example, in order to reverse a surge trend, the fluid flow through the compressor may be adjusted by modifying an amount of fluid recycled through the compressor.

FIG. 1 is a schematic diagram of a conventional system 1 including a compressor 10. The system 1 includes an anti-surge loop 20 through which a part of the fluid output at an outlet 22 of the compressor 10 may be recycled to an inlet 24 of the compressor 10. The amount of fluid recycled via the anti-surge loop 20 depends on an actuator position of an anti-surge valve 30 located along the anti-surge loop 20. An anti-surge controller 40 controls the anti-surge valve 30, thereby determining amount of fluid recycled. The flow through the compressor 10 is modified by modifying the amount of fluid recycled. The compressor 10 receives fluid from an expander 42. Fluid line sensors and fluid handling components are usually present along an anti-surge loop, but FIG. 1 represents a minimal set of elements relevant to the current discussion.

A time delay occurs between when the anti-surge controller 40 transmits a new position to the anti-surge valve 30, and when an actual modification of the flow through the compressor 10 occurs. This time delay is usually designated as a dead time of an anti-surge response. The dead time may be due to a non-linearity of the anti-surge valve's actuator, and delays along fluid transport pipes of the anti-surge loop 20. The dead time effects include a reduction of a stability margin, and poor dynamic performances in order to preserve stability of the system (e.g., a low gain setting).

A schematic diagram of a conventional anti-surge controller used in the conventional system 1 is illustrated in FIG. 2. The conventional anti-surge controller 50 interacts with a process 60. In FIG. 2, the process 60 stands for a system including a compressor (e.g., 10 in FIG. 1) and an anti-surge loop (e.g., 20 in FIG. 1) with an anti-surge valve (e.g., 30 in FIG. 1). The anti-surge controller 50 receives information about the operation of the system (collectively designated as field measures) from the process 60.

A computing block 70 of the anti-surge controller 50 calculates a value of an anti-surge parameter using the field measures received from the process 60. The value of the anti-surge parameter is proportional to a value of the total flow through the compressor, which is a sum of an input flow and the recycled flow of fluid. For example, the anti-surge parameter may be proportional to $h_s \times P_{sd}/P_s$ where $h_s$ is a differential pressure through a flow element located close to the suction of the compressor, $P_{sd}$ is a design value of a suction pressure and $P_s$ is an actual value of the suction pressure.

An add/subtract block 80 compares the calculated value of the anti-surge parameter with a margin, which is a value of the anti-surge parameter considered safe for the operation of the system. A proportional plus integral (PT) controller 90 determines and outputs the new position to the anti-surge valve. Prior to the PI controller 90 a dead-band error filtering block 85 filters the signal input to the PI controller 90 in order to avoid signal noise impacting the new position towards the anti-surge valve. After the PI controller 90 outputs the new position to the anti-surge valve, a rate limiter 95 may adjust the new position to ensure that the position does not vary at a rate larger than an operational safe value.

Shortly after the position has been changed, the field measures do not reflect the change due to the dead time. Therefore, the conventional anti-surge controller may over-correct or under-correct the position sent to the anti-surge valve. No prevention or correction for dead time is provided in the conventional controller. FIG. 3 is a graph of the anti-surge parameter 110 and the position 120 versus time, illustrating the oscillations due to over-correcting of under-correcting the position of the valve.

The presence of the dead time, which can be in the range of 1-10 s, renders the anti-surge loop 20 unstable. In order to avoid this instability, the system 1 may be operated based on an additional margin with respect to the anti-surge line (which may be a line in a graph of a pressure ratio across the compressor versus the flow through the compressor at which a surge phenomenon occurs), but this manner of operation reduces the compressor's operating envelope.

Accordingly, it would be desirable to provide systems and methods that avoid the afore-described problems and drawbacks.

BRIEF SUMMARY OF THE INVENTION

According to one exemplary embodiment, a fluid transport system includes a compressor configured to compress a fluid input therein at a surge pressure, to have a discharge pressure when discharged from the compressor, an anti-surge loop configured to allow a part of the fluid discharged from the compressor to be recycled back into an inlet of the compressor, an anti-surge valve connected to the anti-surge loop and configured to define the part of the fluid recycled based on a position of the anti-surge valve, and an anti-surge valve controller connected to the anti-surge valve, and configured to receive field measures related to a current operation of the fluid transport system, and to calculate and transmit a new position to the anti-surge valve. The new position is calculated to compensate for a delay between when a current position that has been sent to the anti-surge valve, and when an effect of the current position is reflected by the field measures.

According to another embodiment, a method of controlling an anti-surge valve on an anti-surge loop enabling recycling a part of a fluid compressed in a compressor, includes calculating an uncorrected value of an anti-surge parameter based on field measurements related to a current operation of the compressor and the anti-surge loop, estimating a predicted value of the anti-surge parameter using a model having as variables the field measurements and a current position of the anti-surge valve, calculating a corrected value of the anti-surge parameter that is compensated for a delay between when the current position has been sent to the anti-surge valve, and when an effect of the current position is reflected by the field measures, using the uncorrected value and the predicted value, and determining a new position of the anti-surge valve based on a margin, which is a limit value of the anti-surge parameter, and the corrected value of the anti-surge parameter.

According to another embodiment, an anti-surge controller includes an interface configured to receive field measures related to a current operation of a system including a compressor and an anti-surge loop with an anti-surge valve, and to send a new position to the anti-surge valve, a first unit connected to the interface and configured to calculate an uncorrected value of an anti-surge parameter based on the field measurements received via the interface, a second unit connected to the interface and configured to estimate a predicted value of the anti-surge parameter using a deterministic model and based on the field measurements and a current position of the anti-surge valve, and a third unit connected to the first unit, the second unit and the interface, and configured to determine a new position of the anti-surge valve based on a margin, which corresponds to a flow through the compressor that is considered safe for the compressor, and a corrected value of the anti-surge parameter that is compensated for a delay between when the current position is sent to the anti-surge valve and when an effect of the current position is reflected by the field measures, based on the uncorrected value and the predicted value.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION OF THE INVENTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of systems including a compressor with an anti-surge loop. However, the embodiments to be discussed next are not limited to these systems, but may be applied to other systems that require compensating for dead time in an anti-surge loop.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
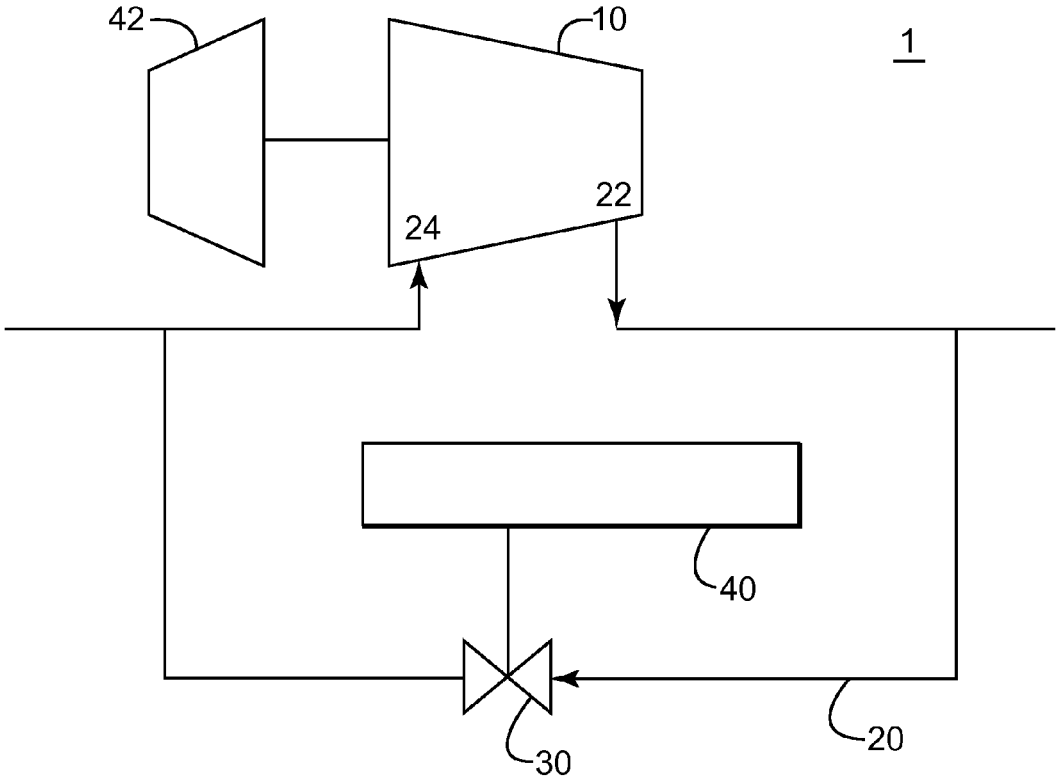
FIG. 1 (Background Art)
FIG. 1 is a schematic diagram of a system including a conventional controller of an anti-surge valve.
Figure 2:
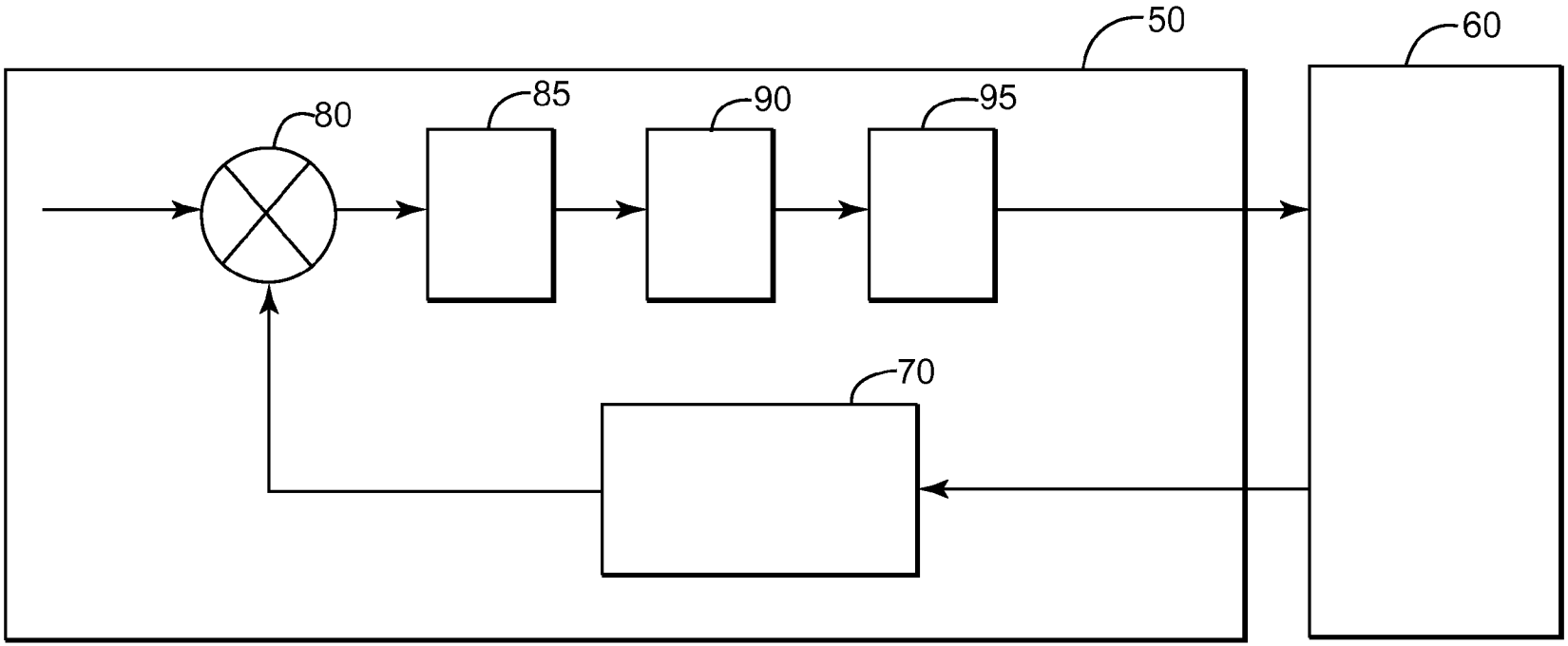
FIG. 2 (Background Art)
FIG. 2 is a schematic diagram of a conventional anti-surge controller.
Figure 3:
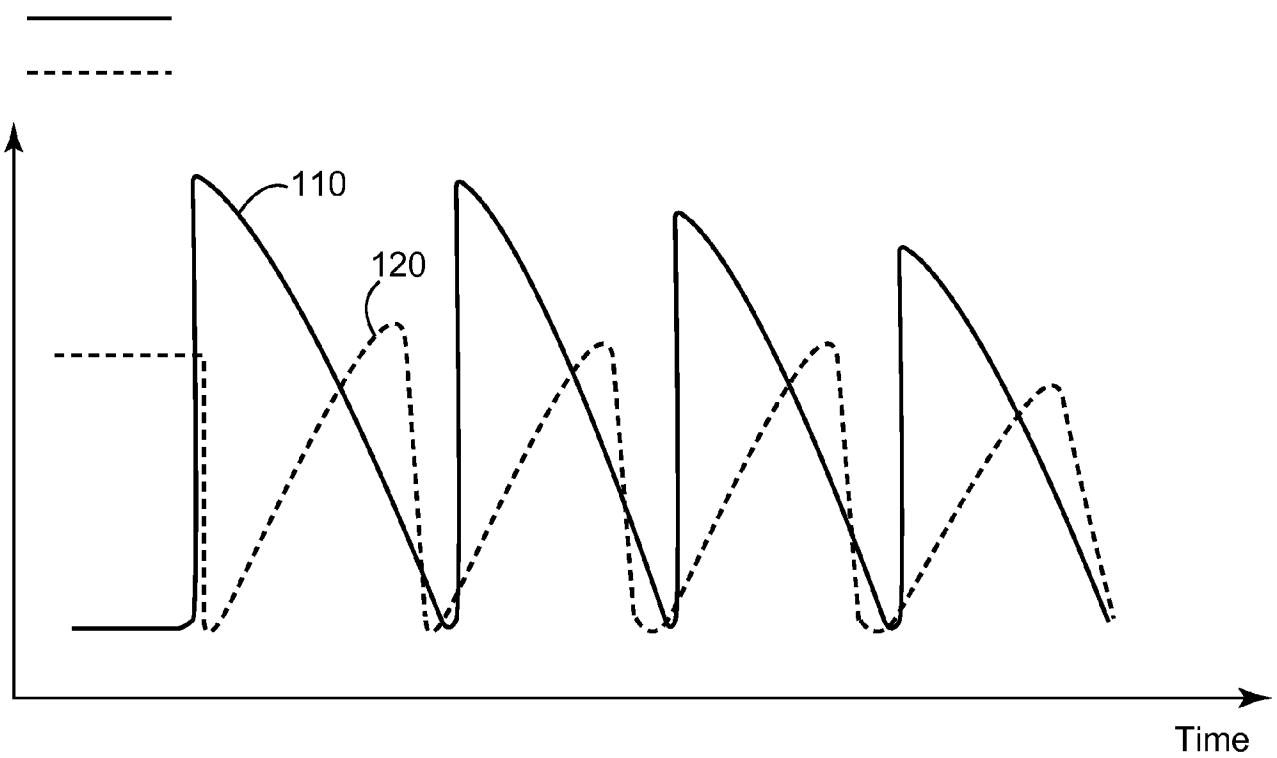
FIG. 3 (Background Art)
FIG. 3 is a graph of the anti-surge parameter and the anti-surge valve position versus time in a conventional system.
Figure 4:
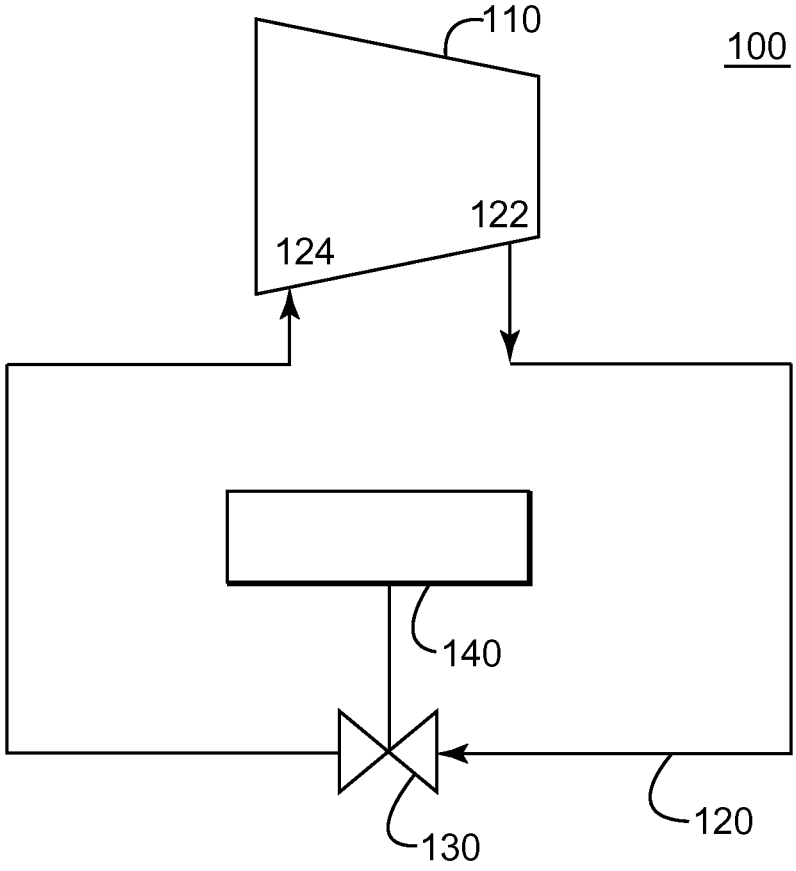
FIG. 4 is a schematic diagram of a system including a controller of an anti-surge valve according to an exemplary embodiment.

FIG. 4 is a schematic diagram of a system 100 including a controller of an anti-surge valve according to an embodiment. The system 100 includes a compressor 110 and an anti-surge loop 120 through which a part of the fluid output by the compressor 110 is recycled from an outlet 122 of the compressor 110 to an inlet 124 of the compressor 110. The amount of fluid recycled via the anti-surge loop 120 depends on a position of an actuator of an anti-surge valve 130 on the anti-surge loop 120. A person of skill in the art would understand that, in the following description, the position of the actuator of the anti-surge valve is referred to as the position of the anti-surge valve.

An anti-surge controller 140 controls the anti-surge valve 130, thereby determining the amount of fluid recycled. The controller 140 receives information about an operation of the system 110 from various sensors and an operating panel of the system (not shown). When a compressor operational point approaches a surge line (e.g., based on the anti-surge parameter approaching the margin) the controller 140 sends a new position to the anti-surge valve 130. Due to the new position, the amount of fluid recycled in the anti-surge loop 120 and the amount of fluid passing through the compressor 110 are modified.

Figure 5:
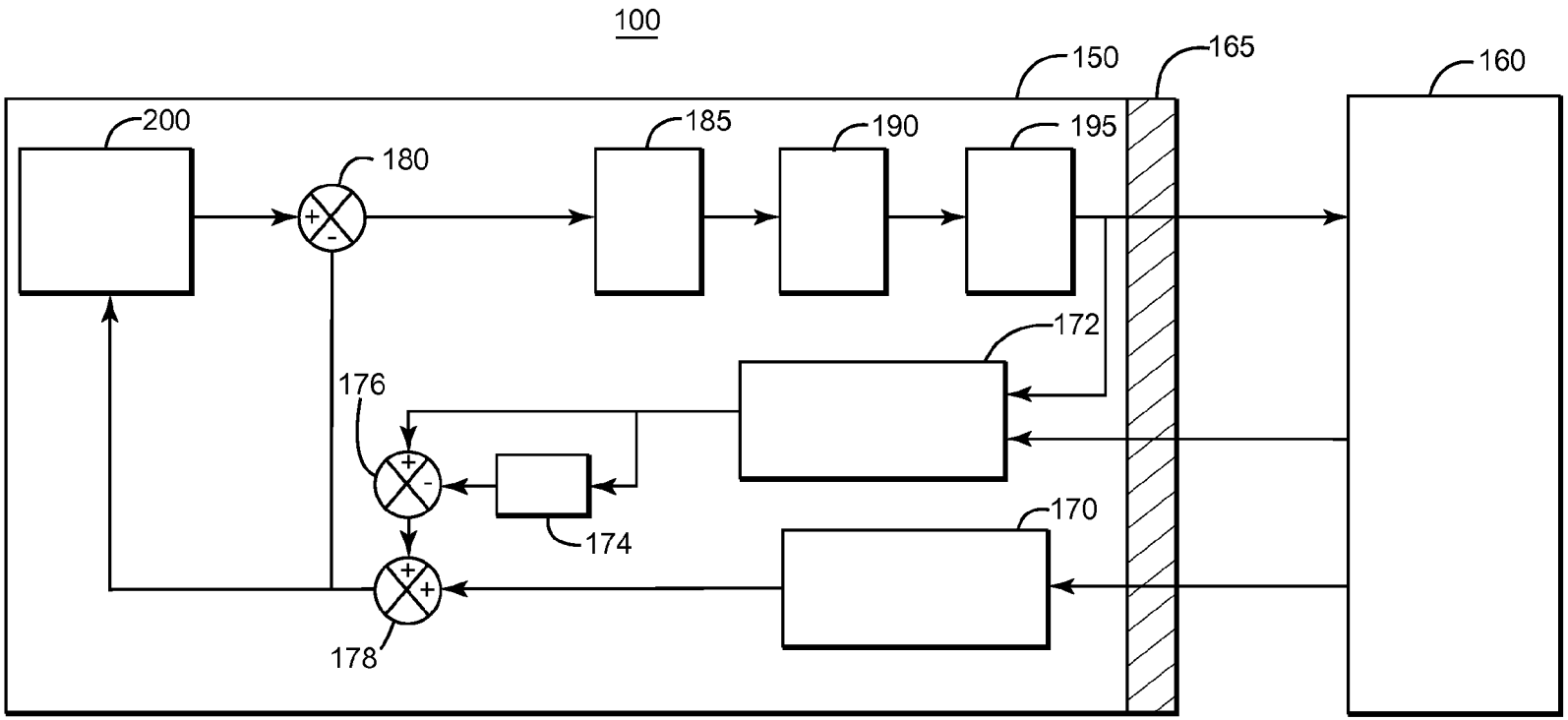
FIG. 5 is a schematic diagram of an anti-surge controller according to an embodiment.

According to an exemplary embodiment, a schematic diagram of an anti-surge controller 150, which may be used in the system 100 illustrated in FIG. 4, is illustrated in FIG. 5. The anti-surge controller 150 interacts with a process 160. The process 160 stands for a system including a compressor (e.g., 110 in FIG. 4) and an anti-surge loop (e.g., 120 in FIG. 4) with an anti-surge valve (e.g., 130 in FIG. 4). The anti-surge controller 150 receives information about the operation of the system (the information being collectively designated as field measures) from the process 160, and sends a position of the anti-surge valve to the process via an interface 165. The field measures include values of various parameters measured by sensors located throughout the system. The blocks 170, 172, 174, 176, 178, 180, 185, 190, 195 and 200 may be circuits, CPUs, logic circuitry, software or a combination thereof.

The computing block 170 of the anti-surge controller 150 calculates an anti-surge parameter using the field measures received from the process 160. For example, the anti-surge parameter may be proportional to the flow through the compressor. In another example, the anti-surge parameter may be a ratio of $h_s \times P_{sd}/P_s$ at the operational point, and a surge limit SL which is the value of $h_s \times P_{sd}/P_s$ on the surge line at the same compression ratio as the operational point. Here, $h_s$ is a differential pressure through a flow element located close to the suction of the compressor, $P_{sd}$ is a design value of the suction pressure, and $P_s$ is an actual value of the suction pressure.

A predicted value of the anti-surge parameter is calculated using a model having the field measures and the current position of the anti-surge valve as variables, via blocks 172, 174, 176, and 178. The model is a deterministic model, i.e., it is based on equations describing the state of the system. Block 172 receives the most recently transmitted position of the anti-surge valve and the field measures from the process 160. Using a model of the system, block 172 estimates a predicted value of the anti-surge parameter while taking into consideration the impact of the most recently transmitted position of the anti-surge valve. In other words, block 172 estimates the anti-surge flow after the transition period (i.e., after the dead time), then uses the estimated anti-surge flow to calculate a predicted total flow through the compressor (which is a sum of an input flow and the estimated anti-surge flow). A value of the differential pressure $h_s$ corresponding to the predicted total flow is then used together with the pressure ratio (i.e., $P_{sd}/P_s$) to estimate a predicted value of the anti-surge parameter.

The predicted value of the anti-surge parameter output from block 172 is input to a delay circuit 174 and an add/subtract circuit 176. The delay circuit 174 may be a Padé filter. The add/subtract circuit 176 outputs a difference between the predicted value of the anti-surge parameter and an earlier predicted value of the anti-surge parameter. Thus, assuming a stationary state with no change of the position of the anti-surge valve, the earlier predicted value of the anti surge-parameter and the current predicted value of the anti-surge parameter should be substantially the same, so no correction is performed (i.e., the same quantity is added and subtracted). However, when the anti-surge valve is opened in response to a new position, the difference between the predicted value of the anti-surge parameter and the earlier predicted value of the anti-surge parameter prevents overcorrecting the current position of the anti-surge valve. Moreover, the use of the difference results in a cancellation of a potential modeling error.

An add circuit 178 adds the difference between the predicted value of the anti-surge parameter and the earlier predicted value of the anti-surge parameter to the calculated value of the anti-surge parameter received from block 176, to output a corrected value of the anti-surge parameter which is compensated for the dead time effect.

The corrected value of the anti-surge parameter is subtracted from a margin, which is a limit value of the anti-surge parameter considered safe for the operation of the system, at the add/subtract block 180. A signal corresponding to this difference is then filtered by a dead-band block 185 to eliminate noise, and input to a proportional plus integral (PI) block 190 which determines and outputs a new position of the anti-surge valve. The new position output by the PI block 190 may be adjusted by a rate limiter 195 in order to ensure that the position does not vary at a rate larger than an operational safe value, and provide the output to the process 160.

The corrected value of the anti-surge parameter may also be input to a block 200 that calculates the margin input to block 180. The margin may be reduced because the system is more stable and an operating envelope of the compressor may be closer to the surge line than when the conventional anti-surge controller is used.

Figure 6:
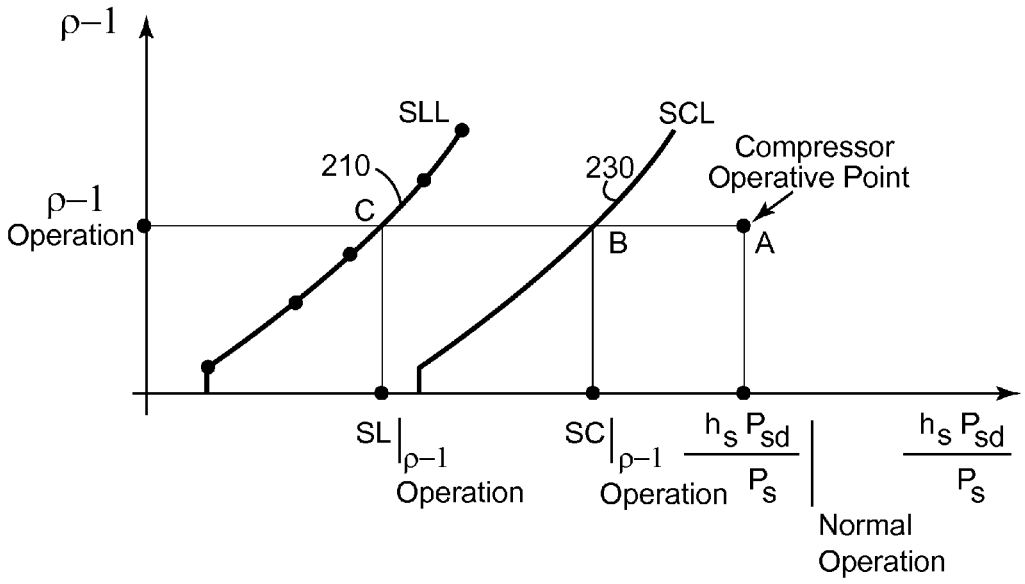
FIG. 6 is a graph illustrating the effect of the anti-surge controller with dead time correction according to an exemplary embodiment.

FIG. 6 is a graph illustrating a surge limit line and a surge control line for a compressor. The y-axis of the graph represents a shifted compression ratio equal to the compression ratio ρ (which is the discharge pressure over the suction pressure) minus 1. The x axis represents a quantity $h_s \times P_{sd}/P_s$, where $h_s$ is a differential pressure through a flow element located close to the suction of the compressor, $P_{sd}$ is a design value of the suction pressure, and $P_s$ is an actual value of the suction pressure. Line 210 is a surge limit line (SLL) at which the surge phenomenon occurs. Line 230 is a surge control line (SCL) beyond which (towards the surge line) the anti-surge controller intervenes. Point A represents a compressor's operative point during normal operation. The x coordinate of point A is the value of $h_s \times P_{sd}/P_s$ during a normal operation at the compression ratio ρ. A line parallel to the x axis intersects the surge control line 230 in point B and the surge limit line 210 in point C. Thus, point A, point B and point C correspond to the same y coordinate, that is, the same (shifted) compression ratio ρ (shifted is ρ−1). The x coordinate of point B is a surge control value $SC|_{\rho-1}$, that is, the value $h_s \times P_{sd}/P_s$ for the compression ratio ρ, below which the anti-surge is activated. The x coordinate of point C is a surge limit value $SL|_{\rho-1}$, that is, the value $h_s \times P_{sd}/P_s$ for the compression ratio ρ, at which the surge occurs. The surge parameter for the operative point A may be calculated as a ratio between the x coordinate (i.e., the value of the quantity $h_s \times P_{sd}/P_s$) of point A and $SL|_{\rho-1}$.

Figure 7:
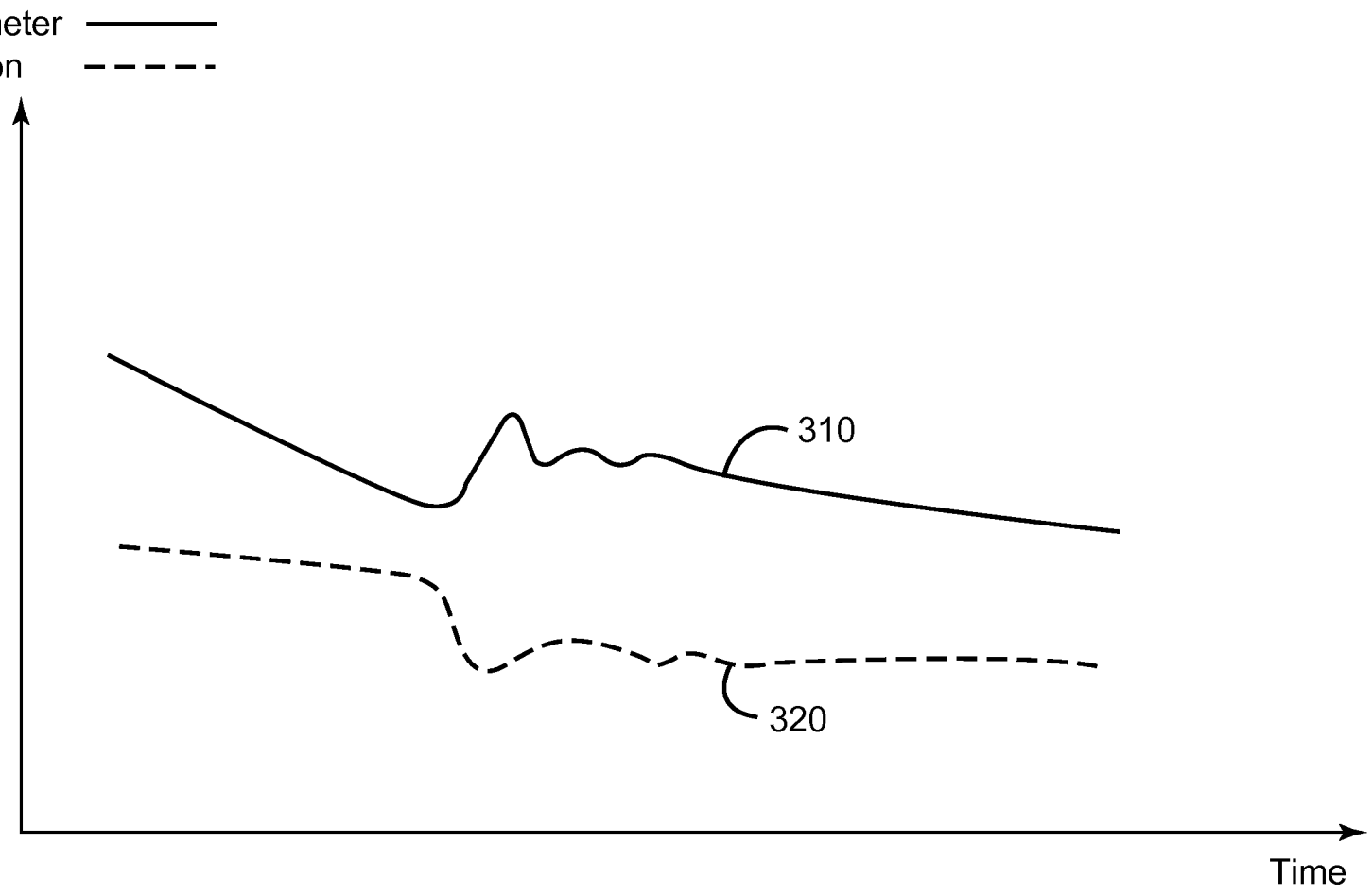
FIG. 7 is a graph of the anti-surge parameter and the anti-surge valve position versus time in a system including an anti-surge controller according to an exemplary embodiment.

As illustrated in FIG. 7, the anti-surge parameter 310 and the valve position 320 have small and rapidly damped oscillations (if any oscillations at all) towards an equilibrium state, when using a novel controller compensating for dead time according to an embodiment.

Figure 8:
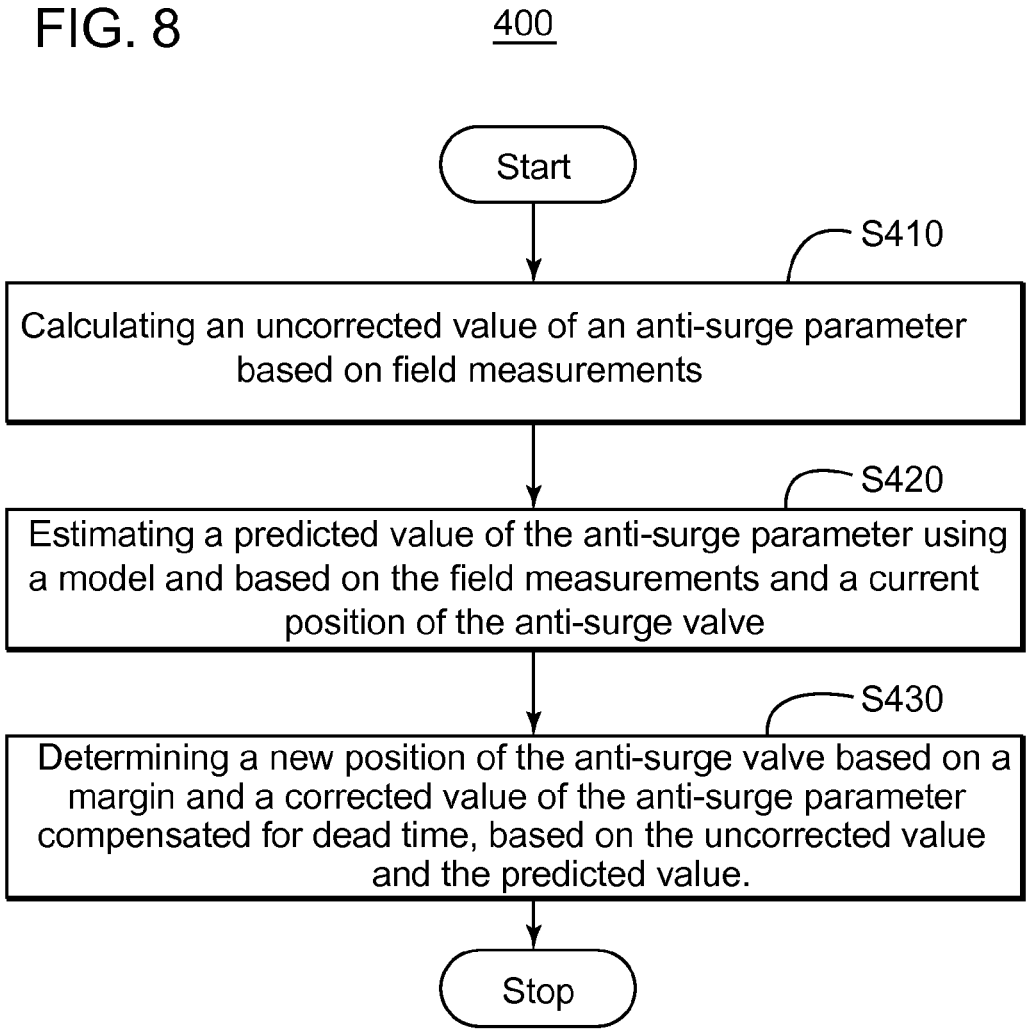
FIG. 8 is a flow chart of a method of controlling an anti-surge valve while correcting for the dead time according to an exemplary embodiment.

FIG. 8 is a flow diagram of a method 400 of controlling an anti-surge valve on an anti-surge loop that enables recycling a part of a fluid compressed in a compressor. At S410, the method 400 includes calculating an uncorrected value of an anti-surge parameter based on field measurements related to a current operation of the fluid transport system. At S420, the method 400 includes estimating a predicted value of the anti-surge parameter using a model and based on the field measurements and a current position of the anti-surge valve. At S430 the method 400 includes determining a new position of the anti-surge valve based on (1) a margin, which corresponds to a flow through the compressor which is considered safe for the compressor, and (2) a corrected value of the anti-surge parameter compensated for a delay between when the current position has been sent to the anti-surge valve and when an effect of the current position is reflected by the field measures. The corrected value is based on the uncorrected value and the predicted value.

The method 400 may further include calculating the corrected value of the anti-surge parameter by adding a difference between the predicted value of the anti-surge parameter and an earlier predicted value of the anti-surge parameter, to the uncorrected value of the anti-surge parameter. The method 400 may also include calculating the margin based on the corrected value of the anti-surge parameter.

The disclosed exemplary embodiments provide system and method for controlling a valve on an anti-surge loop while taking into account the effect of dead time. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A fluid transport system, comprising:

a compressor configured to compress a fluid passing therethrough;

an anti-surge loop configured to allow a part of the fluid, after being discharged from the compressor, to be recycled back into an inlet of the compressor;

an anti-surge valve connected to the anti-surge loop, and configured to modify the flow of part of the fluid recycled, the modification of the flow of the fluid recycled being based on a position of the anti-surge valve; and an anti-surge valve controller connected to the anti-surge valve, and configured to:

receive field measurements related to an anti-surge parameter in the fluid transport system;

predict an anti-surge parameter value after a most recently transmitted position of the anti-surge valve; and modify the most recently transmitted position of the anti-surge valve to compensate for a delay between when the anti-surge controller transmitted the most recent position and when an effect of the most recent position is reflected by the field measurements in the fluid transport system based on the predicted anti-surge parameter value.

2. The fluid transport system of claim 1, wherein the anti-surge valve controller is configured to calculate the modified position of the anti-surge valve based on a difference between a margin, which is a safe value of the anti-surge parameter, and a corrected value of the anti-surge parameter, which corrected value is calculated based on the received field measurements and compensated for the delay by using a model of the fluid transport system defining the predicted values.

3. The fluid transport system of claim 2, wherein the anti-surge valve controller is configured to calculate the corrected value using an uncorrected value of the anti-surge parameter calculated using the field measurements, and an estimated value of the anti-surge parameter using the field measurements and the most recent position of the anti-surge valve as variables input to the model.

4. The fluid transport system of claim 3, wherein the anti-surge valve controller is configured to calculate the uncorrected value of the anti-surge parameter as proportional to a differential pressure measurement of a flow element located close to a suction of the compressor weighted by a ratio of a design suction pressure and a current value of the suction pressure, the differential pressure measurement and the current value of the suction pressure being included in the field measurements.

5. The fluid transport system of claim 3, wherein the anti-surge valve controller is configured to calculate the corrected value of the anti-surge parameter by adding a difference between the estimated value of the anti-surge parameter and an earlier estimated value of the anti-surge parameter, to the uncorrected value of the anti-surge parameter.

6. The fluid transport system of claim 1, wherein the anti-surge valve controller comprises a Padé filter as a delay circuit to provide the earlier estimated value of the anti-surge parameter.

7. The fluid transport system of claim 1, wherein the anti-surge parameter is a function of a total fluid flow passing through the compressor, the total fluid flow being a sum of an input flow and a flow of the part of the fluid which is recycled.

8. The fluid transport system of claim 2, wherein the anti-surge valve controller is configured to calculate the margin based on the corrected value of the anti-surge parameter.

* * * * *